US009284019B2

(12) United States Patent
Rickborn et al.

(10) Patent No.: US 9,284,019 B2
(45) Date of Patent: Mar. 15, 2016

(54) ELLIPSOIDAL V-HULL

(71) Applicants: Christopher Rickborn, Hollywood, FL (US); Spencer Rickborn, Hollywood, FL (US)

(72) Inventors: Christopher Rickborn, Hollywood, FL (US); Spencer Rickborn, Hollywood, FL (US)

( * ) Notice: Subject to any disclaimer, the term of this patent is extended or adjusted under 35 U.S.C. 154(b) by 0 days.

(21) Appl. No.: 14/280,143

(22) Filed: May 16, 2014

(65) Prior Publication Data

US 2014/0338579 A1 Nov. 20, 2014

Related U.S. Application Data

(60) Provisional application No. 61/824,339, filed on May 16, 2013.

(51) Int. Cl.

| | |
|---|---|
| ***B63B 5/24*** | (2006.01) |
| ***B63B 1/20*** | (2006.01) |
| ***B63B 3/14*** | (2006.01) |
| *B63B 1/04* | (2006.01) |
| *B63B 3/38* | (2006.01) |

(52) U.S. Cl.

CPC ... *B63B 5/24* (2013.01); *B63B 1/20* (2013.01); *B63B 3/14* (2013.01); *B63B 1/042* (2013.01); *B63B 3/38* (2013.01); *B63B 2001/201* (2013.01)

(58) Field of Classification Search

CPC ..... B63B 3/14; B63B 1/00; B63B 1/04; B63B 1/16; B63B 1/18; B63B 1/20

USPC ..... 114/61.32, 61.33, 271, 273, 291

See application file for complete search history.

(56) References Cited

U.S. PATENT DOCUMENTS

| | | | | |
|---|---|---|---|---|
| 2,989,939 | A * | 6/1961 | Tatter | 114/61.32 |
| 4,193,370 | A | 3/1980 | Schoell | |
| 5,063,868 | A * | 11/1991 | Fink, Jr. | 114/271 |
| 5,224,436 | A * | 7/1993 | Stricker | 114/271 |
| 5,394,819 | A * | 3/1995 | Aarnio | 114/271 |
| 5,456,202 | A | 10/1995 | Schoell | |
| RE36,879 | E | 9/2000 | Schoell | |
| 6,925,953 | B1 * | 8/2005 | Batista et al. | 114/291 |
| 7,543,544 | B2 | 6/2009 | Yap | |
| 7,984,683 | B1 | 7/2011 | Hupy | |

* cited by examiner

*Primary Examiner* — Lars A Olson

(74) *Attorney, Agent, or Firm* — Allen F. Bennett; Bennett Intellectual Property

(57) ABSTRACT

An improved boat hull design includes a region of ellipsiodal fullness in the forward portion of the hull, ellipsiodal curvature over the remainder of the hull, a chine with a chine flat with an increasing width as it approaches the stern and one or more strakes. One of the strakes is located where the chine flat meets the V portion of the hull. The hull provides stability and a smooth ride at both high and low speeds in smooth and rough water and is highly maneuverable. The hull also has good weight carrying ability at speed while not requiring excessive power. The hull minimizes rolling when stationary or at low speed in waves.

2 Claims, 4 Drawing Sheets

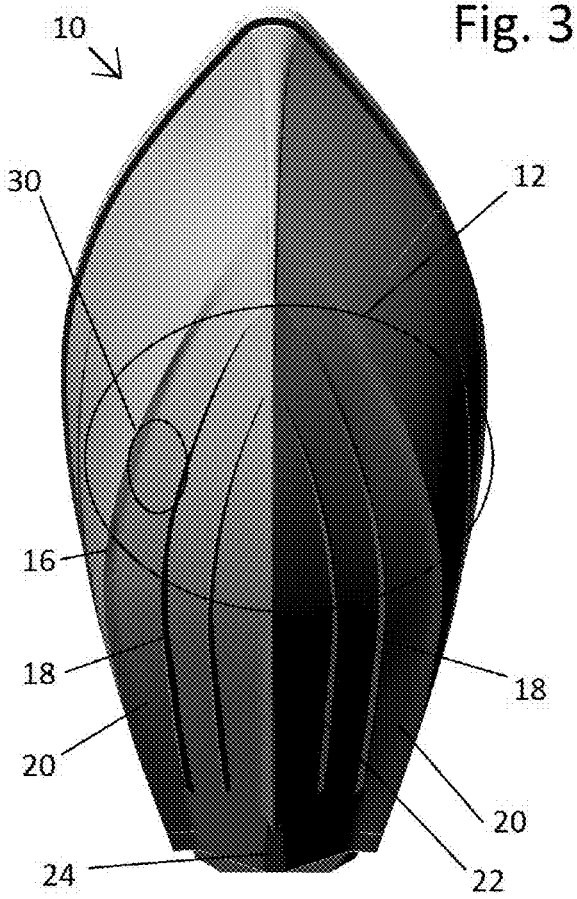
Fig. 3
Fig. 4
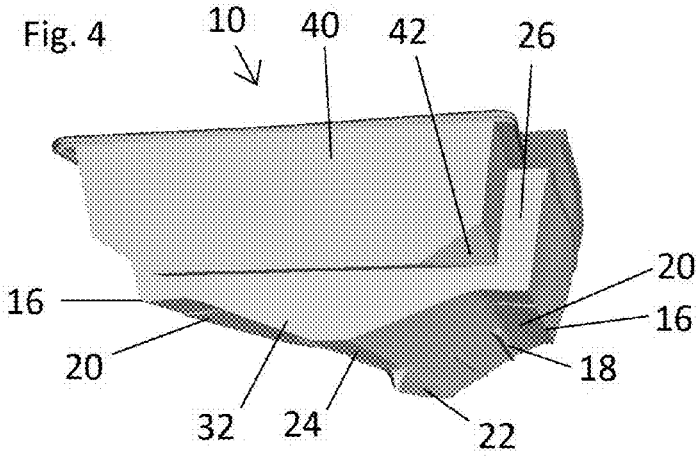

ELLIPSOIDAL V-HULL

BACKGROUND OF THE INVENTION

1. Field of Endeavor

The present invention relates to apparatuses, systems and methods for improved boat of both mono-hull and multi-hull designs. More particularly, the invention relates to boat hulls modified to provide better fuel economy, maneuverability, a smoother ride at both high and low speeds, less side to side rolling motion when stationary in waves and greater weight carrying capacity.

2. Background Information

Boat hull design has been a constantly evolving field of art for thousands of years. In particular, the development of non-wind propulsion systems, material science and other technologies, has contributed to many advances in hull design over the past two hundred years.

Flat-bottom boats have a large, substantially flat hull bottom, making them very stable in calm weather. Characteristically, however, the flat, broad bow area creates a rough ride. These boats are usually limited to low horsepower motors because they do not generally handle well at high speed. Flat-bottom boats are also well suited for shallow water.

Early in nautical history, boats were powered by wind or by hand-stroked oars. Early boat designers found that boats went faster, and were easier to steer, if the bow was pointed. They also soon discovered that by lowering the center of gravity, the sailing boats had better stability, and usually kept the boat upright even in bad weather.

With the advent of mechanical power came boats with "planing" hulls, which lift the boat partially out of the water to skim on the surface allowing the boat to be operated at higher speeds for the same power. "Displacement" hulls push through or cruise through the water instead of skimming on the surface and are not able to operate at the higher speeds of a planing hull.

"Semi Displacement" hulls act in a manner part way between Displacement hulls and Planing hulls. At slow speeds they are more efficient than Planing hulls but not as efficient as Displacement hulls, while at medium speed they are more efficient than both Displacement and Planing hulls. Semi Displacement hulls are not usually able to operate at the high speeds typical of Planing hulls but are able to operate efficiently at higher speeds than a Displacement hull.

The V bottom boat is probably the most common hull design for planing hulls. Most manufacturers of performance boats built today use variations of this design. This design offers a reasonable ride in rough water as the pointed bow slices through the water forward and the V-shaped bottom softens the slamming of the boat in waves. The angle of the V is called "deadrise". A sharper V has more deadrise. Some "V"-bottom boats have a small, local flat surface at the very bottom of the aft end called a "pad." This pad creates a little more lift which increases top speed but at the sacrifice of a little softness in the ride.

A chine in V bottom planing or semi-displacement power boat hull forms refers to the hard corner or edge at the intersection between the hull bottom and the hull side.

With sailboats, it is common to have a rounded hull with no strakes or chines. A keel is often employed. However, the keel of a sailboat generally is generally deep vertically in proportion to the overall depth of the hull. On modern designs, it does not typically run the length of the boat.

Boats having a flatbottom, are stable at low speed while also being maneuverable and provide a large displaced volume for a given draft, thus accommodating more weight.

A deep V hull provides a relatively smooth ride at high speed. However, at low speed a deep V hull is very inefficient. Furthermore, at low speeds, a deep V hull is less stable, less maneuverable and tends to roll side to side to a high degree when side on to the waves.

Many attempts have been made to design hulls that combine features of flatbottom, round and/or deep V hulls in an effort to design hulls exhibiting the advantages of each.

In view of the foregoing, there is a need to provide a hull design that performs well at both high and low speeds. It is therefore desirable to provide a hull combining improved performance and ride comfort of any of the existing hulls at speed and in waves and improved comfort of any of the existing hulls at slow speed in waves and when stationary in waves.

BRIEF SUMMARY OF THE INVENTION

Accordingly, the primary object of the present invention is to provide a boat hull that provides a smooth ride at both high and low speeds with good fuel economy and maneuverability. Another objective is to provide better load carrying capacity at speed and greater comfort (less rolling motion) when stationary in waves.

In one embodiment a modified hull design combines features found on various hull designs. The forward region of the hull may have a bulbous, i.e. ellipsiodal, shape from which an ellipsiodal shaped keel may extend toward the stern. Chines, strakes and spoilers may by combined to reduce drag at lower and higher speeds typical of a flatbottom hull or a deep V hull while also having ride comfort better that that of a deep hull boat at higher speeds in waves. Lifting strakes, or spoilers, may also contribute to reduce drag. An aft centerline pad may also be incorporated into the hull design.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 3 is a bottom view of an ellipsoidal V hull in accordance with the principles of the invention;

FIG. 4 is a rear perspective view of an ellipsoidal V hull in accordance with the principles of the invention;

DETAILED DESCRIPTION

Figure 1:
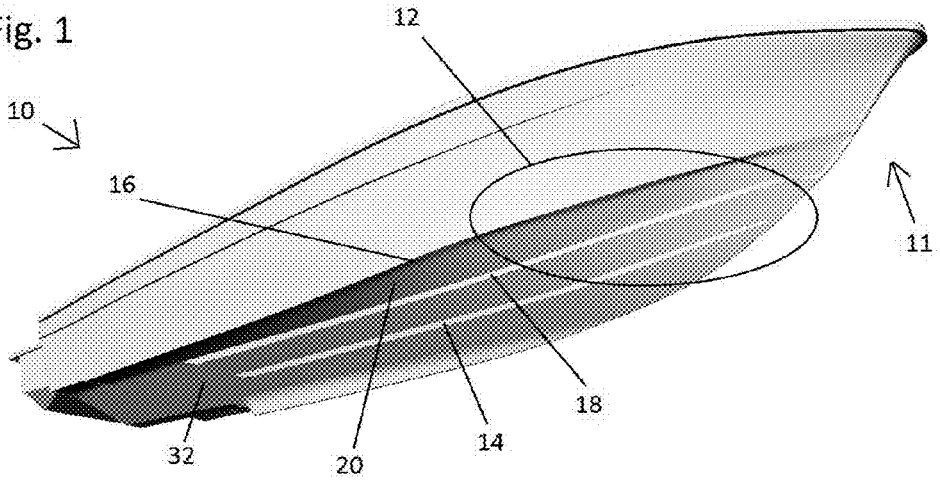
FIG. 1 is a forward perspective view of an ellipsoidal V hull in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a hull design that combines features found on various different hull designs. The forward region of the hull may have a bulbous, i.e. ellipsiodal, shape from which an ellipsiodal shaped keel may extend toward the stern. Modified chines and strakes may by combined to reduce drag at lower speeds typical of a flatbottom boat while also having the stability of a deep hull boat at higher speeds. Lifting strakes, or spoilers, may also contribute to reduce drag. An aft centerline pad may also be incorporated into the hull design.

The forefoot and forward hull above the static waterline may feature an ellipsoidal fullness that may allow for a natural water flow in the bow area whether immersed in a wave or riding level in flat water. This fullness may create a more level and smoother ride when riding at speed into a head sea.

The hull may also have a mid and aft ellipsoidal fullness aft of the forefoot and forward ellipsiodal fullness. The ellipsoidal fullness may continue to a lesser extent all the way to the transom. Without being bound by theory, the inventor believes that the mid and aft ellipsiodal fullness may work synergistically with the forefoot and forward ellipsiodal fullness to allow for a more natural water flow and makes for a smoother ride in large chop conditions.

The hull may also include an outer hull and chine flat combination. The chine and chine flat at the bow may be of a conventional design. Aft of the bow, in the area at the aft end of the forefoot and forward ellipsiodal fullness, the chine flat may become wider and may sweep around the mid and aft ellipsoidal fullness. The deadrise angle of the hull in this area may gradually flatten until it becomes a continuation of the chine flat as one wide surface on each side of the hull. This wide chine flat may continue aft with a slight negative deadrise angle. The wide chine flat may vary in deadrise and width, and may be stepped in the transverse direction. The outer hull and chine flat combination may create extremely high levels of stability both at speed and when stationary in wave and cross wave conditions.

At the aft end of the forward ellipsoidal fullness, a shallow keel with an ellipsoidal plan view and tapered in cross section, may be blended into the hull with a large radius which at the forward end may create a small forward fin at the aft end of the forward ellipsiodal fullness. The keel may have a tear drop shape similar to an airfoil. The aft end of the keel may taper to a fine section to promote clean water flow. The keel may promote natural water flow, and may enhance slow speed and at rest stability especially in cross waves, and works together with the forward ellipsiodal fullness and the mid and aft ellipsoidal fullness to create a smoother ride in large chop conditions.

A flat centerline pad may provide lift at speed and is also used to control planing attitude in extreme conditions.

On each side of the hull there may be one or more lifting strakes also to be known as spoilers. The outboard edges of the spoilers may be lower than the inboard edges (negative deadrise) and the inboard and outboard edges may be blended into the hull with a radius on each edge. Without being bound by theory, the spoilers may create lift and may simultaneously interact synergistically with the keel and with the wide aft chine flat to create a smoother, more stable ride in large chop conditions and in slow speed or when stationary in cross wave conditions.

FIG. 1 shows a boat hull 10 in accordance with the principles of the present invention. The bow 11 of the hull 10 may have a deadrise greater than the deadrise further aft. In the ellipsiodal region 12, the hull has an ellipsoidal fullness. This region is generally located in the forward 25% of the hull. This design may allow the vessel to ride level and smoothly through rough water conditions. About where the ellipsoid region 12 of the forward end of the hull ends, the chine flat 20 sweeps gracefully wider as the chine 16 progresses sternward. The ellipsoidal region 12 at the forward end of the hull combined with the gradually widening chine flat 20, between the chine 16 and the spoiler 18, may allow the hull to be stable at both high speeds and at low speeds. A lifting strake, or spoiler 18, runs most of the length of the hull and is positioned approximately where the chine flat 20 meets the bottom portion 32 of the hull 10.

Figure 2:
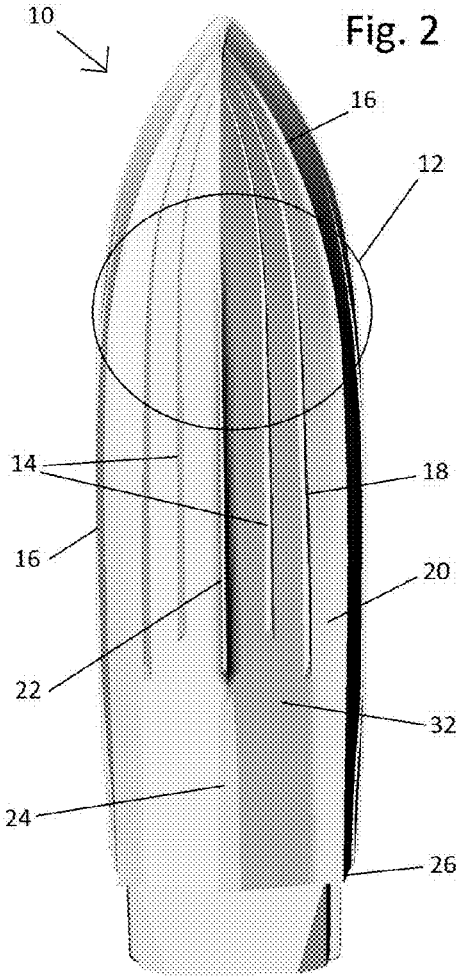
FIG. 2 is a bottom perspective view of an ellipsoidal V hull in accordance with the principles of the invention.

FIG. 2 shows a bottom view of the hull 10 in accordance with the principles of the invention. A keel 22 extends from the ellipsoidal region 12 of the hull 10 toward the stern. The keel 22 may be ellipsoidal also, thicker toward the front and tapering toward the stern. The keel 22 ends approximately 25% of the length of the boat from the transom 26. The keel 22 may feed water cleanly back together to the stern and propeller area. The keel 22 may also blend into a ellipsoidal V with a radius to the hull, causing it to act as a forward fin. The spoiler 18 may also work in conjunction with the keel. As water is forced up the bottom 32 of the hull 10 it comes in the contact with the spoiler 18 and is forced back down, thereby creating more lift and a smoother, more stable ride. At the same time, due to the close proximity of spoiler 18 to the chine flat 20, the water may interact with the chine flat 20 to minimize drag while also minimizing slamming in waves. Aft of the keel 22 a flat pad 24 may provide lift and control of planing attitude at higher speeds.

FIG. 3 also shows the hull 10 of a boat in accordance with the principles of the invention. Region 30 is located between the spoiler 18 and the chine 16 and has a general three dimensional curvature which may reduce the slamming effect in waves. Region 30 may allow a more natural movement of water over the hull in this area.

FIG. 4 shows a rear view of a hull 10 in accordance with the principles of the invention. Here it may be seen that spoiler 18 is located where the chine flat 20 meets the bottom region 32 of the hull 10. The bottom region 32 of the hull 10 may have a shallow dead rise angle. This may provide shallow draft and stability that interact synergistically with the ellipsoidal region 12 of the hull 10 to increase buoyancy.

FIG. 4 also shows bracket 40 having beveled anti-trip corners 42 that reduce tripping and drag when turning. The beveled corners 42 may also minimize chine walking forces at speed in rough conditions.

Figure 5:
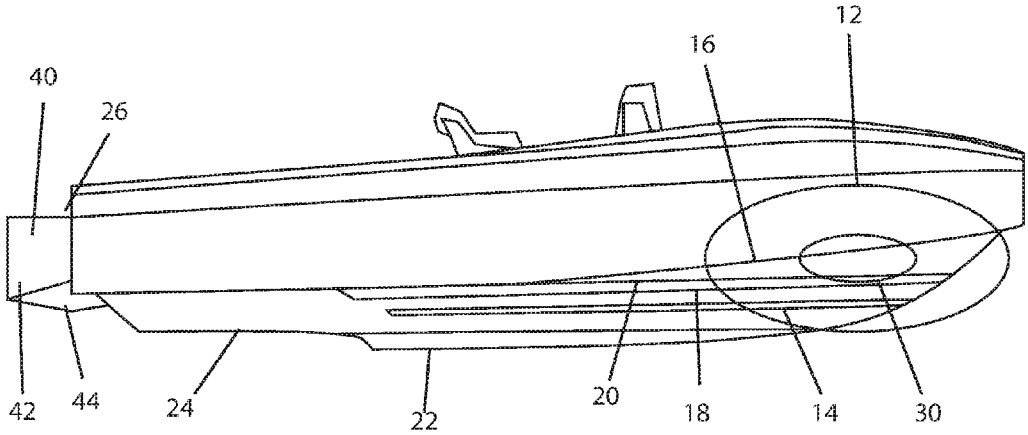
FIG. 5 is a side view of an ellipsoidal V hull in accordance with the principles of the invention.

FIG. 5 shows a side view of a hull 10 in accordance with principles of the invention. Region 30 lies within the ellipsoidal region 12 just below chine 16. Bracket 40 may also be seen with beveled corner 42. The bottom 44 of the bracket 40 has a slight downward angle as it extends from the stern 26. This may reduce the minimum planing speed and increase efficiency.

One method of forming a hull having a region 30 and an ellipsoidal region 12 may include applying pressure to a fiberglass hull in order to alter its shape. Fiberglass has some inherent flexibility. By applying pressure to a fiberglass hull to press it into a desired shape, the flexibility is reduced.

Figure 6:
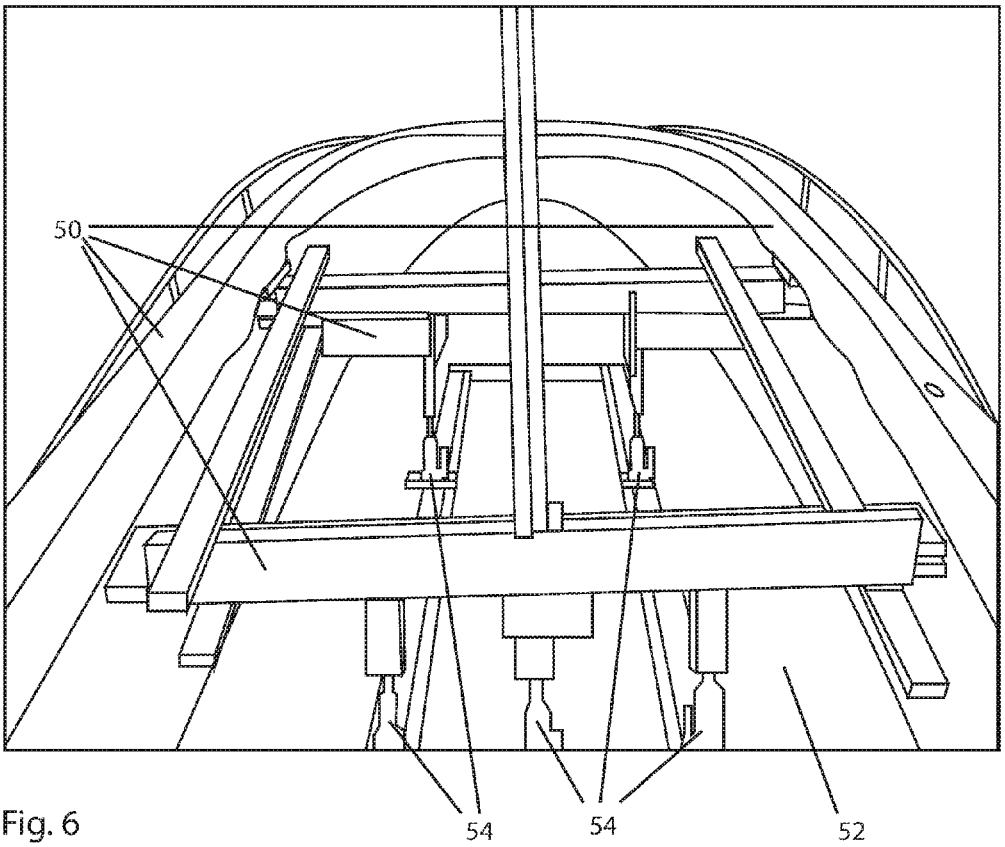
FIG. 6 is a perspective view of an ellipsoidal V hull in accordance with the principles of the invention.
Figure 7:
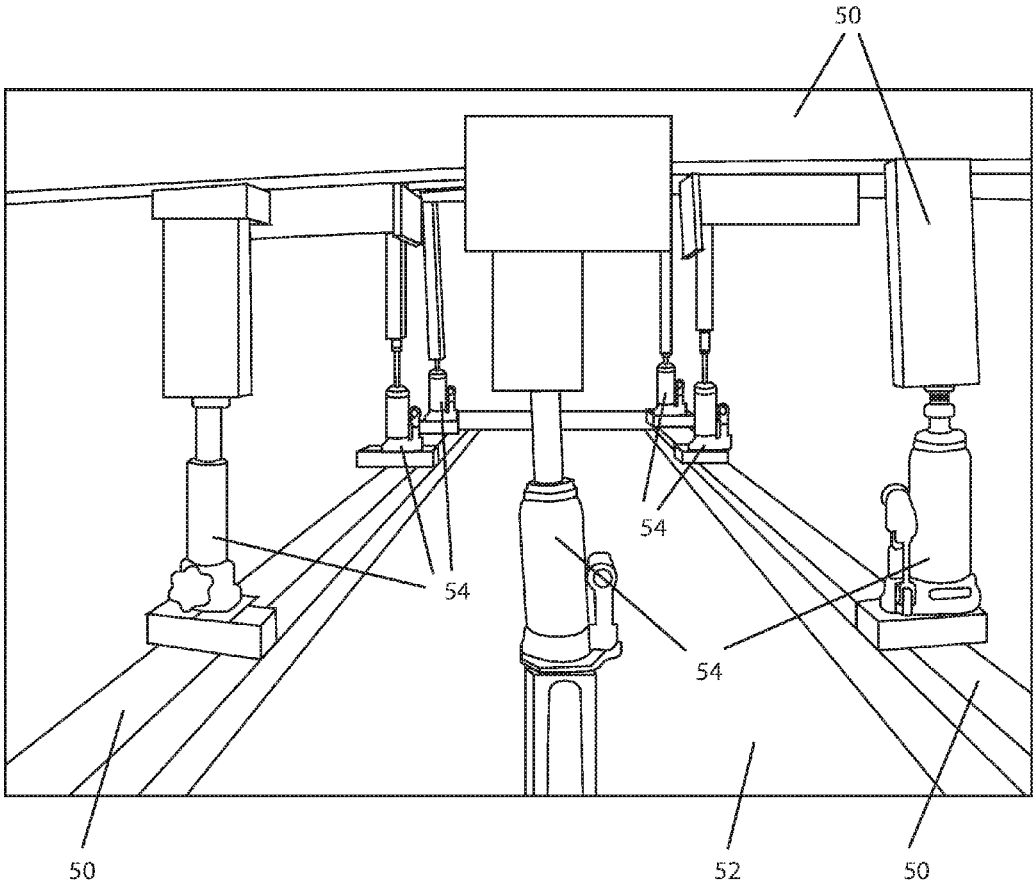
FIG. 7 is a perspective view of an ellipsoidal V hull in accordance with the principles of the invention.

FIGS. 6 and 7 show a fiberglass hull being pressed into a desired shape. A plurality of beams 50 are placed within the hull 52. Hydraulic presses 54 are placed between the beams 50 and exert a constant, steady pressure on the hull 52. Over time, the fiberglass bends permanently in response to this pressure, and its physical properties are altered. This method allows the fiberglass to be formed into a less flexible hull.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. An ellipsoidal V hull having a length defined by a bow and a stern and having an ellipsoidal region in the forward 25% of the length of the hull, a chine, a chine flat, a spoiler where the chine flat meets a bottom portion of the hull, a keel and a pad aft of the keel;

wherein the chine flat has substantially the same deadrise angle as the hull in the forward 25% of the length of the hull, the deadrise angle of the chine flat decreases to 0 as the chine flat extends from the forward 25% of the hull to a midpoint of the hull, and the deadrise angle of the chine flat remains 0 from the midpoint of the hull to the stern;

wherein the keel begins at a point 25% of the length of the hull from the bow and extends to a point 75% of the length of the hull from the bow; and, wherein the spoiler extends from the bow toward the stern and ends about 75% of the length of the hull from the bow.

2. The ellipsoidal V hull of claim 1 further comprising a bracket having a width less than the width of the hull and beveled corners and a downward angle.

* * * * *